US005844376A

United States Patent [19]

Lapatovich

[11] Patent Number: 5,844,376

[45] Date of Patent: Dec. 1, 1998

[54] ELECTRODELESS HIGH INTENSITY DISCHARGE LAMP WITH SPLIT LAMP STEM

[75] Inventor: Walter P. Lapatovich, Boxford, Mass.

[73] Assignee: Osram Sylvania Inc., Danvers, Mass.

[21] Appl. No.: 682,814

[22] Filed: Jul. 11, 1996

[51] Int. Cl.[6] ..... H01J 65/04

[52] U.S. Cl. ..... 315/248; 315/344; 313/161; 313/634

[58] Field of Search ..... 315/39, 248, 267, 315/344; 362/294, 285, 286, 287, 373; 313/493, 161, 634

[56] References Cited

U.S. PATENT DOCUMENTS

| | | | |
|---|---|---|---|
| 4,673,846 | 6/1987 | Yoshizawa et al. | 315/39 X |
| 4,947,080 | 8/1990 | Wood et al. | 315/248 |
| 4,954,756 | 9/1990 | Wood et al. | 315/39 |
| 5,070,277 | 12/1991 | Lapatovich | 315/248 |
| 5,113,121 | 5/1992 | Lapatovich et al. | 315/248 |
| 5,130,612 | 7/1992 | Lapatovich et al. | 315/248 |
| 5,144,206 | 9/1992 | Butler et al. | 315/248 |
| 5,241,246 | 8/1993 | Lapatovich et al. | 315/248 |
| 5,373,216 | 12/1994 | Dakin et al. | 315/248 |

FOREIGN PATENT DOCUMENTS

| | | |
|---|---|---|
| 158662 | 7/1986 | Japan . |

*Primary Examiner*—Benny T. Lee
*Attorney, Agent, or Firm*—Carlo S. Bessone

[57] ABSTRACT

An electrodeless lamp capsule includes a light-transmissive discharge envelope enclosing a discharge volume containing a mixture of starting gas and chemical dopant material excitable by high frequency power to a state of luminous emission, and a lamp stem attached to the discharge envelope. The lamp stem includes a first section having a first cross-sectional area and a second section attached to the discharge envelope. The second section of the lamp stem has a second cross-sectional area that is less than the first cross-sectional area. The lamp stem may be a tube having a longitudinal slot which defines spaced-apart, first and second elements that are attached to the discharge envelope. The first and second elements have a relatively small total cross-sectional area for conducting heat from the discharge envelope and permit secure attachment of the lamp stem to the discharge envelope.

13 Claims, 2 Drawing Sheets

ELECTRODELESS HIGH INTENSITY DISCHARGE LAMP WITH SPLIT LAMP STEM

FIELD OF THE INVENTION

This invention relates to electrodeless high intensity discharge lamps and, more particularly, to an electrodeless lamp capsule construction wherein the lamp stem is slotted or otherwise reduced in cross-sectional area in a region where it attaches to the discharge envelope of the lamp capsule.

BACKGROUND OF THE INVENTION

Electrodeless high intensity discharge (HID) lamps have been described extensively in the prior art. In general, electrodeless HID lamps include an electrodeless lamp capsule containing a volatilizable fill material and a starting gas. The lamp capsule is mounted in a fixture which is designed for coupling high frequency power to the lamp capsule. The high frequency power produces a light-emitting plasma discharge within the lamp capsule. Recent advances in the application of microwave power to lamp capsules operating in the tens of watts range are disclosed in U.S. Pat. No. 5,070,277, issued on Dec. 3, 1991, to Lapatovich; U.S. Pat. No. 5,113,121, issued May 12, 1992, to Lapatovich, et al.; U.S. Pat. No. 5,130,612, issued Jul. 14, 1992, to Lapatovich, et al.; U.S. Pat. No. 5,144,206, issued Sep. 1, 1992, to Butler, et al.; and U.S. Pat. No. 5,241,246, issued Aug. 31, 1993, to Lapatovich, et al. As a result, compact electrodeless HID lamps and associated applicators have become practical.

The above patents disclose small, cylindrical lamp capsules wherein high frequency power is coupled to opposite ends of the lamp capsule with a 180° phase shift. The applied electric field is generally colinear with the axis of the lamp capsule and produces a substantially linear discharge within the lamp capsule. The fixture for coupling high frequency energy to the lamp capsule typically includes a planar transmission line, such as a microstrip transmission line, with electric field applicators, such as helices, cups or loops, positioned at opposite ends of the lamp capsule. The microstrip transmission line couples high frequency power to the electric field applicators with a 180° phase shift. The lamp capsule is typically positioned in a gap in the substrate of the microstrip transmission line and is spaced above the plane of the substrate by a few millimeters, so that the axis of the lamp capsule is colinear with the axes of the field applicators.

Electrodeless HID lamps have no electrodes and therefore have no electrical inleads which may be used for mechanical support of the lamp capsule in the lamp assembly relative to the electric field applicators. Prior art electrodeless HID lamps have been mounted in cavities and in power applicators using a lamp stem of material identical to the composition of the lamp capsule, usually vitreous silica (commonly called quartz). Prior art electrodeless lamps have utilized a solid rod, a tube, or both as a lamp stem, as disclosed for example in the aforementioned U.S. Pat. No. 5,070,277. The prior art configurations provide generally satisfactory mechanical support of the electrodeless lamp capsule.

Recently it has been recognized that in low wattage applications, conserving heat in the lamp capsule is important in achieving optimum lamp performance. In particular, heat loss may result in cold spot formation and unsatisfactory vapor pressure of the chemical dopant material, typically a metal halide salt. Heat is lost by surface radiation, by convection, and by conduction through the supporting lamp stem. Consequently, configurations which limit or reduce heat loss may improve lamp performance by alleviating cold spot formation. An electrodeless high intensity discharge lamp having a stabilized condensate location is disclosed in U.S. Pat. No. 5,373,216, issued Dec. 13, 1994, to Dakin, et al.

SUMMARY OF THE INVENTION

According to one aspect of the invention, an electrodeless lamp capsule is provided. The electrodeless lamp capsule comprises a light-transmissive discharge envelope enclosing a discharge volume containing a mixture of starting gas and chemical dopant material excitable by high frequency power to a state of luminous emission, and a lamp stem attached to the discharge envelope. The lamp stem comprises a first section having a first cross-sectional area and a second section attached to the discharge envelope. The second section of the lamp stem has a second cross-sectional area that is less than the first cross-sectional area.

Preferably, the first section of the lamp stem comprises a tube and the second section comprises a length of the tube having a longitudinal slot. The longitudinal slot defines spaced-apart first and second elements which are attached to the discharge envelope. The spaced-apart first and second elements have a relatively small total cross-sectional area for conducting heat from the discharge envelope and provide a secure attachment of the lamp stem to the discharge envelope.

According to another aspect of the invention, an electrodeless lamp assembly is provided. The electrodeless lamp assembly comprises an electrodeless lamp capsule including a light-transmissive discharge envelope enclosing a discharge volume containing a mixture of starting gas and chemical dopant material excitable by high frequency power to a state of luminous emission, and a lamp stem attached to the discharge envelope. The lamp stem comprises a first section having a first cross-sectional area and a second section attached to the discharge envelope. The second section of the lamp stem has a second cross-sectional area that is less than the first cross-sectional area. The lamp assembly further comprises at least one electric field applicator for coupling high frequency power to the lamp capsule, a transmission line for coupling high frequency power from an input to the electric field applicator, and a support member coupled to the lamp stem for positioning the discharge envelope of the lamp capsule relative to the electric field applicator.

According to a further aspect of the invention, a method for making an electrodeless lamp capsule is provided. The method comprises the steps of forming a light-transmissive discharge envelope enclosing a discharge volume, dosing the discharge volume with a mixture of starting gas and chemical dopant material excitable by high frequency power to a state of luminous emission, forming a lamp stem comprising a first section having a first cross-sectional area and a second section having a second cross-sectional area that is less than the first cross-sectional area, and attaching the second section of the lamp stem to the discharge envelope.

BRIEF DESCRIPTION OF THE DRAWINGS

For a better understanding of the present invention, reference is made to the accompanying drawings, which are incorporated herein by reference and in which.

DETAILED DESCRIPTION OF THE INVENTION

Figure 1:
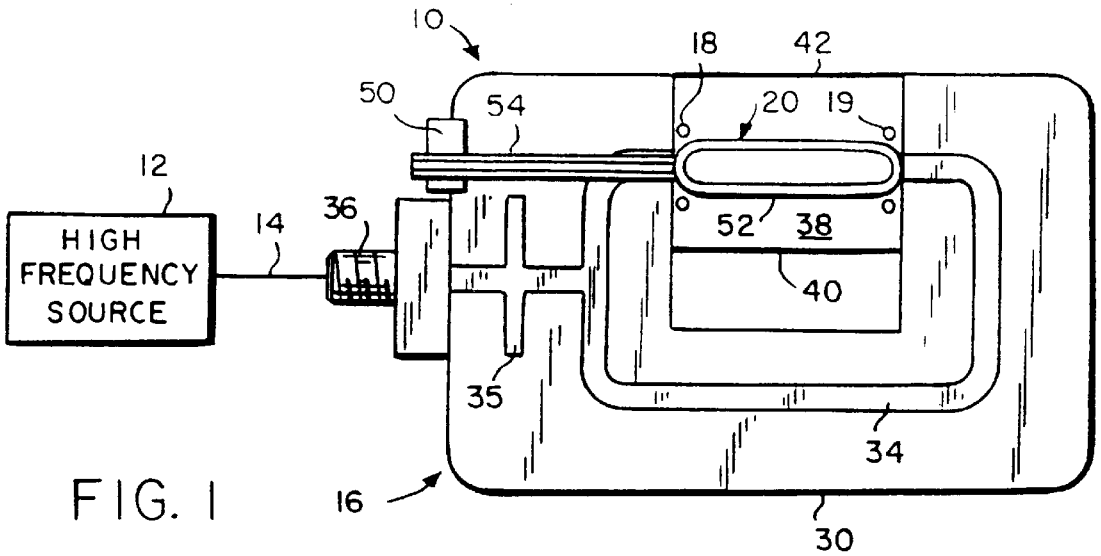
FIG. 1 is a schematic representation of an embodiment of an electrodeless high intensity discharge lamp system in accordance with the present invention.

An example of an electrodeless, high-intensity discharge lamp system in accordance with the invention is shown in FIG. 1. The lamp system includes an electrodeless lamp assembly 10 and a high frequency source 12. High frequency power from the source 12 is coupled to the electrodeless lamp assembly 10 through a transmission line 14, which may for example be a coaxial cable. The electrodeless lamp assembly 10 includes a planar transmission line 16, electric field applicators 18 and 19, and a lamp capsule 20 having an enclosed discharge volume containing a lamp fill material. The lamp capsule 20 contains a mixture of starting gas and chemical dopant material that is excitable by high frequency power to a state of luminous emission.

The planar transmission line 16 includes a substrate 30 having a patterned conductor 34 coupled to a high frequency connector 36. The connector 36 is coupled via transmission line 14 to high frequency source 12. The conductor 34 interconnects the connector 36 and the electric field applicators 18 and 19. The conductor 34 is designed to provide a phase shift of 180° between applicators 18 and 19 at the frequency of source 12 and may including a tuning stub 35. The opposite surface of substrate 30 is covered with a conductive ground plane (not shown in FIG. 1). The substrate 30 is provided with a gap 38 in which the lamp capsule 20 is mounted. The lamp capsule 20 is spaced above the plane of substrate 30 and is aligned with the electric field applicators 18 and 19. Electrically conductive wires 40 and 42 may be connected between opposite sides of gap 38 to symmetrize the electric field in the region of lamp capsule 20.

The lamp capsule 20 is mechanically supported above the surface of substrate 30 by a support block 50. Lamp capsule 20 includes a discharge envelope 52 and a lamp stem 54 that extends from one end of the discharge envelope 52. The lamp stem 54 is cemented to support block 50, so that the lamp capsule 20 is spaced above substrate 30 in alignment with electric field applicators 18 and 19.

Figure 2:
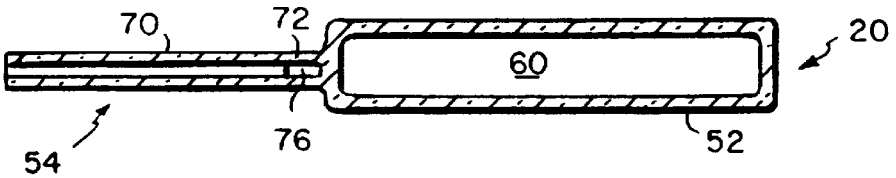
FIG. 2 is a cross-sectional view of an embodiment of an electrodeless lamp capsule in accordance with the present invention.
Figure 3:
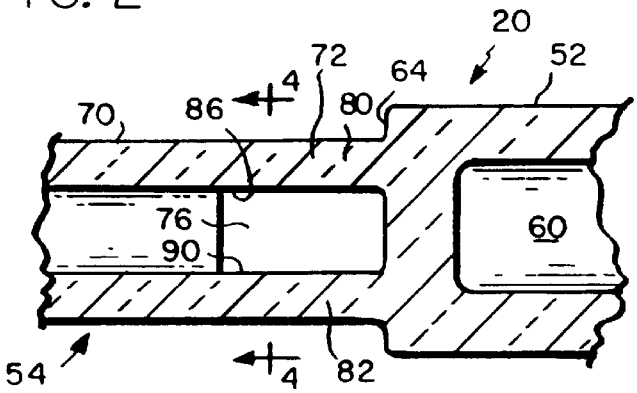
FIG. 3 is an enlarged partial cross-sectional view of the lamp capsule of FIG. 2.

The lamp capsule 20 is shown in greater detail in FIGS. 2, 3. The discharge envelope 52 encloses a sealed discharge volume 60 which contains a mixture of a volatilizable fill material and a low pressure inert gas for starting, such as argon, krypton, xenon or nitrogen in a pressure range of 1 to 100 torr. The volatilizable fill material, when volatilized, is partially ionized and partially excited to radiating states so that useful light is emitted by the discharge. The fill material can, for example, be mercury and NaSc halide salt or other metal salts. Other fill materials not containing mercury may also be utilized. When the lamp capsule is operating and hot, the internal pressure is between 1 and 50 atmospheres. Other fill materials known to those skilled in the art may be utilized to generate visible, ultraviolet or infrared radiation.

The discharge envelope 52 is fabricated of a light-transmissive material, such as quartz, and may have a generally cylindrical shape. In one example, the discharge envelope 52 has an outside diameter of 4.0 millimeters, an inside diameter of 2.0 millimeters, and a length of 10 millimeters. Discharge envelopes with different sizes and shapes are included within the scope of the present invention.

Figure 4:
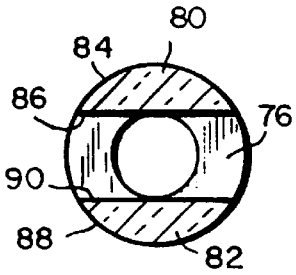
FIG. 4 is a cross-sectional view of the lamp stem taken along the line 4—4 of FIG. 3.

Lamp stem 54 may be attached to one end 64 (see FIG. 3) of discharge envelope 52. Lamp stem 54 includes a first section 70 and a second section 72. Second section 72 of lamp stem 54 is attached to discharge envelope 52. In the embodiment of FIGS. 2–4, the first section 70 (see FIGS. 2,3) of lamp stem 54 comprises a length of tube, and the second section 72 (see FIGS. 2,3) comprises a length of the same tube having a longitudinal slot 76. The slot 76 defines a first element 80 and a second element 82 on opposite sides of slot 76 as shown in FIGS. 3,4. The elements 80 and 82 are attached to discharge envelope 52 (see FIG.3).

As best shown in FIG. 4, element 80 has a cross-section bounded by an arc 84 and a wall 86 (also seen in FIG. 3) of slot 76. Similarly, element 82 has a cross-section bounded by an arc 88 and a wall 90 (also seen in FIG. 3) of slot 76. By contrast, the first section 70 of lamp stem 54 comprises an unslotted tube and has a cross-sectional area bounded by the inside and outside diameters of the tube. As is apparent from FIG. 4, elements 80 and 82 have a total cross-sectional area that is less than the cross-sectional area of first section 70 of lamp stem 54.

The lamp stem 54 is attached to discharge envelope 52 by first element 80 and second element 82 of second section 72 as shown in FIG. 3. Thus, the cross-sectional area for the conduction of thermal energy from discharge envelope 52 is established by the total cross-sectional area of elements 80 and 82. The heat conducted from the discharge envelope 52 through lamp stem 54 is given by $$Q=k\nabla T\cdot A$$

where Q is the heat loss, k is the thermal conductance of the lamp stem material, $\nabla T$ is the temperature differential between the discharge envelope 52 and the lamp stem 54, and A is the cross-sectional area at the point of attachment of the lamp stem 54 to the discharge envelope 52. The heat conducted from the hot discharge envelope is reduced in proportion to the cross-sectional area of the lamp stem 54 at the point of attachment to the discharge envelope 52. The reduction in cross-sectional area in comparison with a standard, full circumference tube depends on the dimensions of slot 76. Typically, the cross-sectional area can be reduced by about 20% to 60%, thus reducing heat loss in the same proportion.

The configuration of FIGS. 2–4 has the advantage that the cross-sectional area at the point of attachment between lamp stem 54 and discharge envelope 52 is reduced, while providing two points of attachment of the lamp stem 54 to discharge envelope 52. The two point attachment is mechanically more stable than a single, small area attachment between the lamp stem and the discharge envelope. In general, the invention involves the attachment of a lamp stem to a discharge envelope using two or more spaced-apart elements (such as elements 80 and 82) which provide mechanical stability and which have a smaller total cross-sectional area than the tubular or rod-shaped portion of the lamp stem to limit thermal transfer from the discharge envelope.

Figure 5:
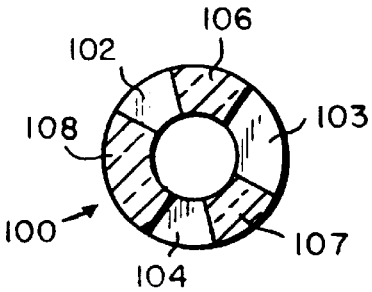
FIG. 5 is a cross-sectional view of a lamp stem showing a Y slot configuration.
Figure 6:
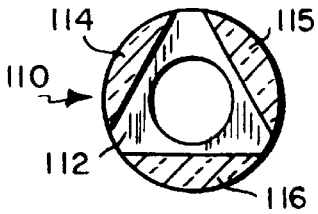
FIG. 6 is a cross-sectional view of a lamp stem showing a delta slot configuration.

The slot 76 can have any configuration which reduces in the cross-sectional area of the lamp stem at the attachment between the lamp stem and the discharge envelope, while permitting a mechanically secure attachment to the discharge envelope. For example, the slot may extend through one wall of the tube to its center but not through the opposite wall. Examples of other suitable configurations are shown in FIGS. 5 and 6. FIGS. 5 and 6 show cross-sections of lamp stems near the point of attachment to the discharge envelope. In FIG. 5, a tube 100 has three slots 102, 103, and 104 which form a Y configuration. The slots 102, 103 and 104 define elements 106, 107 and 108 which provide three point attachment to the discharge envelope. In FIG. 6, a tube 110 has a delta slot 112 which defines elements 114, 115 and 116. The elements 114, 115 and 116 provide three point attachment to the discharge envelope.

In one example, the lamp stem utilizes quartz tubing having a 2.2 millimeter outside diameter and a 1.0 millimeter inside diameter, and is approximately 15 millimeters in length. The slot 76 has a width of 1.0 millimeter and an axial length of 1.5 millimeters. This configuration produces a reduction in cross-sectional area relative to the full circumference tube of approximately 44%.

The electrodeless lamp capsule of the present invention may be fabricated as follows. The discharge envelope 52 is made by closing the ends of a quartz tube and dosing the discharge volume with a mixture of starting gas and chemical dopant material, using techniques well known in the art. A lamp stem is formed by slotting one end of a quartz tube as shown in FIGS. 3 and 4. The lamp stem may, for example, be slotted with a diamond wheel or a tungsten carbide saw. Then the slotted end of the lamp stem is attached to one end of the discharge envelope. More specifically, the spaced-apart elements on opposite sides of the slot formed in the end of the lamp stem may be fused to the end of the discharge envelope.

As indicated above, the disclosed lamp capsule configuration results in higher temperature operation of the lamp capsule 20 and thereby reduces cold spots at which the fill material may condense. An additional benefit of this configuration is the reduced heat load on the support structure and on the adhesives used to attach the lamp stem 54 to the support block 50.

The electric field applicators 18 and 19 may comprise helical couplers as disclosed in the aforementioned U.S. Pat. No. 5,070,277; end cup applicators as disclosed in the aforementioned U.S. Pat. No. 5,241,246; loop applicators as disclosed in the aforementioned U.S. Pat. No. 5,130,612; or any other suitable electric field applicator. In general, the electric field applicators produce a high intensity electric field within the enclosed discharge volume of the lamp capsule, so that the applied high frequency power is absorbed by the plasma discharge.

The high intensity discharge lamp of the present invention can operate at any frequency in the range of 13 megahertz to 20 gigahertz at which substantial power can be developed. The operating frequency is typically selected in one of the ISM bands. The frequencies centered around 915 megahertz and 2.45 gigahertz are particularly appropriate.

The planar transmission line 16 is designed to couple high frequency power at the operating frequency to the electric field applicators 18 and 19 with 180° phase shift. The design and construction of planar transmission lines for transmission of high frequency power are well known to those skilled in the art. The substrate 30 of the planar transmission line is a dielectric material, such as for example, glass, microfiber reinforced PTFE, composite laminate or BEO having an approximate relative dielectric constant of 2.5 to 10.0 and having a thickness of 0.030 to 0.062 inch. The conductor 34 is patterned on one surface of the substrate, and a ground plane conductor is formed on the opposite surface of the substrate. Examples of suitable planar transmission lines include stripline and microstripline transmission lines.

Figure 7:
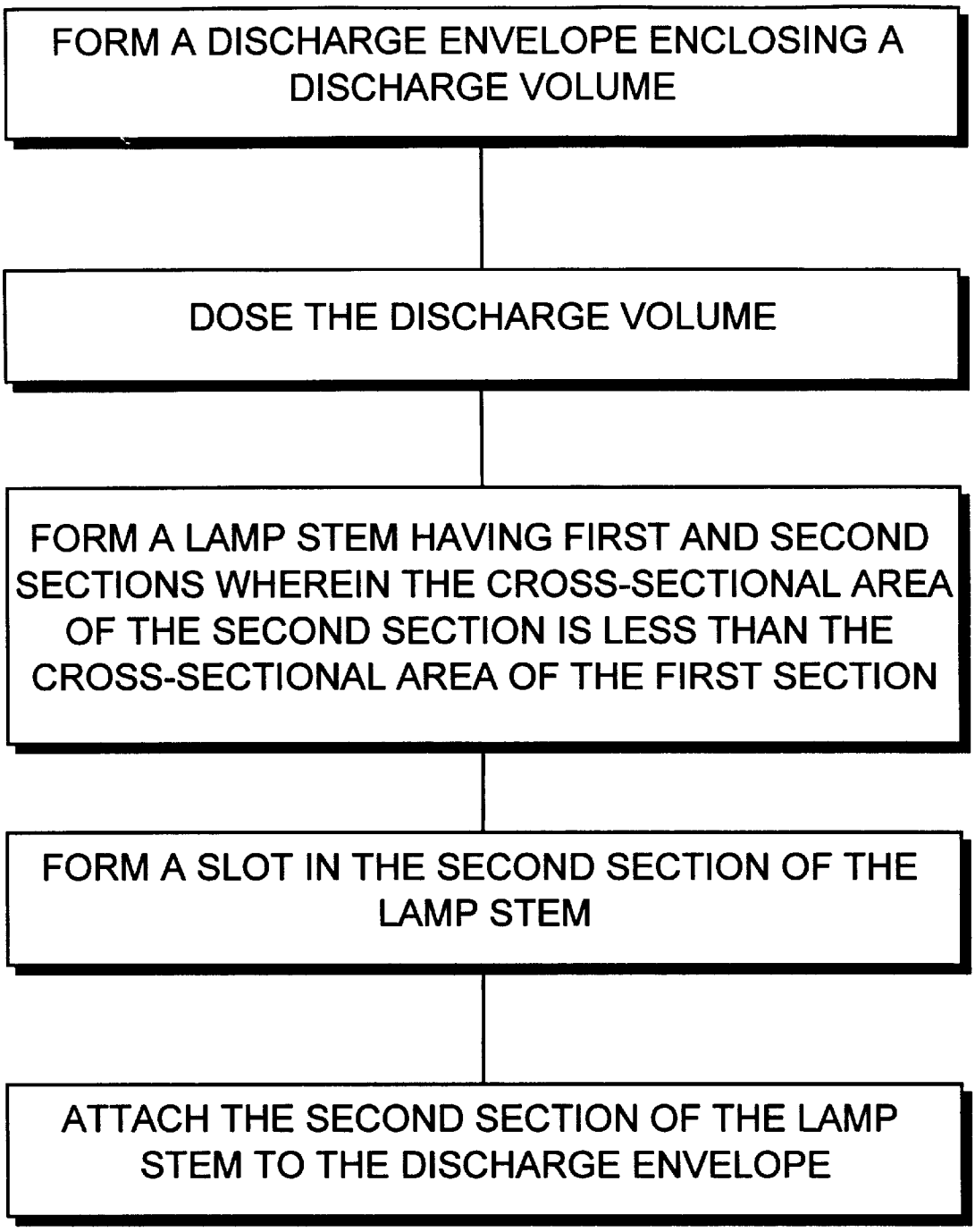
FIG. 7 is a flow diagram of a method of making an electrodeless lamp capsule in accordance with the present invention.

FIG. 7 is a flow diagram of a method of making an electrodeless lamp capsule in accordance with the present invention. The method includes the steps of forming a light-transmissive discharge envelope enclosing a discharge volume; dosing the discharge volume with a mixture of starting gas and chemical dopant material excitable by high frequency power to a state of luminous emission; forming a lamp stem comprising a first section having a first cross-sectional area and a second section having a second cross-sectional area that is less than the first cross-sectional area; forming a slot in the second section of the lamp stem; and attaching the second section of the lamp stem to the discharge envelope.

While there have been shown and described what are at present considered the preferred embodiments of the present invention, it will be obvious to those skilled in the art that various changes and modifications may be made therein without departing from the scope of the invention as defined by the appended claims.

What is claimed is:

1. An electrodeless lamp capsule comprising a light-transmissive discharge envelope enclosing a discharge volume containing a mixture of starting gas and chemical dopant material excitable by high frequency power to a state of luminous emission, and a lamp stem attached to said discharge envelope, said lamp stem comprising a first section having a first cross-sectional area and a second section attached to said discharge envelope, said second section of said lamp stem having a longitudinal slot therein and having a second cross-sectional area that is less than said first cross-sectional area.

2. An electrodeless lamp capsule as defined in claim 1 wherein the first section of said lamp stem comprises a tube and wherein said second section is an integral extension of said first section.

3. An electrodeless lamp capsule as defined in claim 2 wherein said slot separated said second section into spaced-apart first and second elements which are attached to said discharge envelope.

4. An electrodeless lamp capsule as defined in claim 1 wherein said second section comprises spaced-apart first and second elements attached to said discharge envelope and separated by said slot.

5. An electrodeless lamp capsule as defined in claim 1 wherein said discharge envelope is generally cylindrical and wherein said lamp stem is attached to one end of said cylindrical discharge envelope.

6. An electrodeless lamp assembly comprising:

an electrodeless lamp capsule including a light-transmissive discharge envelope enclosing a discharge volume containing a mixture of starting gas and chemical dopant material excitable by high frequency power to a state of luminous emission, and a lamp stem attached to said discharge envelope, said lamp stem comprising a first section having a first cross-sectional area and a second section attached to said discharge envelope, said second section of said lamp stem having a longitudinal slot therein and having a second cross-sectional area that is less than said first cross-sectional area;

at least one electric field applicator for coupling said high frequency power to said lamp capsule;

a transmission line for coupling said high frequency power from an input to said at least one electric field applicator; and a support member coupled to said lamp stem for positioning the discharge envelope of said lamp capsule relative to said at least one electric field applicator.

7. An electrodeless lamp assembly as defined in claim 6 wherein said discharge envelope is generally cylindrical and wherein said lamp stem is attached to one end of said cylindrical discharge envelope.

8. An electrodeless lamp assembly as defined in claim 6 wherein the first section of said lamp stem comprises a tube and wherein said slot separates said second section into spaced-apart first and second elements which are attached to said discharge envelope.

9. An electrodeless lamp assembly as defined in claim 6 wherein said second section comprises spaced-apart first and second elements attached to said discharge envelope and separated by said slot.

10. A method for making an electrodeless lamp capsule, comprising the steps of:

forming a light-transmissive discharge envelope enclosing a discharge volume;

dosing said discharge volume with a mixture of starting gas and chemical dopant material excitable by high frequency power to a state of luminous emission;

forming a lamp stem comprising a first section having a first cross-sectional area and a second section having a second cross-sectional area that is less than said first cross-sectional area;

forming a slot in said second section of said lamp stem; and attaching the second section of said lamp stem to said discharge envelope.

11. A method for making an electrodeless lamp capsule as defined in claim 10 wherein the step of forming a slot comprises forming said second section with spaced-apart first and second elements for attachment to said discharge envelope.

12. A method for making an electrodeless lamp capsule as defined in claim 10 wherein the step of forming said lamp stem comprises providing a tube and forming said slot in a portion of said tube, wherein the portion of said tube having said slot constitutes the second section of said lamp stem.

13. A method for making an electrodeless lamp capsule as defined in claim 10 wherein the step of attaching the second section of said lamp stem to said discharge envelope comprises fusing the second section of said lamp stem to said discharge envelope.

* * * * *